US007302922B2

(12) United States Patent
Schön et al.

(10) Patent No.: US 7,302,922 B2
(45) Date of Patent: Dec. 4, 2007

(54) DEVICE FOR THE VARIABLE ACTUATION OF GAS EXCHANGE VALVES OF INTERNAL COMBUSTION ENGINES AND METHOD FOR OPERATING SAID DEVICE

(75) Inventors: Helmut Schön, Frastanz (AT); Gordon Köhne, Bregenz (AT); Peter Kuhn, Weinheim (DE); Frank Obrist, Dornbim (AT)

(73) Assignee: Thyssenkrupp Automotive AG, Bochum (DE)

( * ) Notice: Subject to any disclaimer, the term of this patent is extended or adjusted under 35 U.S.C. 154(b) by 0 days.

(21) Appl. No.: 10/551,539

(22) PCT Filed: Mar. 17, 2004

(86) PCT No.: PCT/EP2004/002740

§ 371 (c)(1),
(2), (4) Date: Sep. 14, 2005

(87) PCT Pub. No.: WO2004/085802

PCT Pub. Date: Oct. 7, 2004

(65) Prior Publication Data

US 2007/0000461 A1 Jan. 4, 2007

(30) Foreign Application Priority Data

Mar. 24, 2003 (DE) ..... 103 12 958

(51) Int. Cl.
*F01L 1/34* (2006.01)

(52) U.S. Cl. ..... 123/90.16; 123/90.2; 123/90.39

(58) Field of Classification Search ..... 123/90.16, 123/90.2, 90.39, 90.41, 90.44; 74/559, 567, 74/569

See application file for complete search history.

(56) References Cited

U.S. PATENT DOCUMENTS 6,886,512 B2 * 5/2005 Naumann ..... 123/90.39

FOREIGN PATENT DOCUMENTS

WO WO 02092972 A1 * 11/2002

* cited by examiner

*Primary Examiner*—Ching Chang
(74) *Attorney, Agent, or Firm*—Max Fogiel

(57) ABSTRACT

The invention is characterized in that the gas exchange valves of a cylinder are displaced in a displacement unit (15, 34) jointly and independently of the displacement of the displacement devices of the other cylinders. Every displacement unit (15, 34) is associated with separate actuators for actuating the same. Angle of rotation sensors (42, 43) are provided to detect the angle or rotation signals of the crankshaft and the camshaft or any other shaft rotating at half the crankshaft speed. These angle of rotation signals are used to derive the common idle phase of all valves of a cylinder to be jointly adjusted, a control unit (44) effecting the displacement of every displacement unit (15, 34) during said common idle phase.

16 Claims, 6 Drawing Sheets

DEVICE FOR THE VARIABLE ACTUATION OF GAS EXCHANGE VALVES OF INTERNAL COMBUSTION ENGINES AND METHOD FOR OPERATING SAID DEVICE

The present application is a national stage application under 35 U.S.C. 371 based on International Application No. PCT/EP04/02740, filed on Mar. 17, 2004, and further claims priority under 35 U.S.C. 119 of Germany Patent Application No. 103 12 958.8 filed on Mar. 24, 2003.

BACKGROUND OF THE INVENTION

The present invention relates to a device for variable actuation of gas exchange valves of internal combustion engines.

Such devices are used to control gas exchange valves in such a way as to make it possible to operate reciprocating engines without the throttle valve that would otherwise be necessary.

Such a device is disclosed in DE 101 23 186 A1, for example. In this device, a rotating cam first drives a connecting link, which executes a pure oscillating rotary motion and carries a radial cam, which is composed of a rest area and a lift area. The radial cam transfers the lifting curve necessary for actuation of the valve to the roller of a driven element similar to a cam follower which in turn actuates the valve. The desired different valve lifting curves are produced by the fact that the center of rotation of the connecting link is displaced on an arc-shaped path which is concentric to the roller of the driven element when it is in the position that it assumes when the valve is closed. The center of rotation is formed by a roller which is provided on the connecting link and which is supported in a non-positive manner on an arc-shaped track in the housing; this track is also concentric to the roller of the driven element, that is, it forms an equidistant to the path of the center of rotation and is designated as the coulisse. In addition, the roller on the connecting link is supported against a cam disk, whose angular position determines the position of the center of rotation on its arc-shaped path.

DE 101 00 173 describes a completely variable valve train which has driving means, for example a cam and, arranged between the driving means and the gas exchange valve, a connecting link, which acts indirectly on the gas exchange valve; the valve stroke can be changed by adjusting an adjustable guide element.

Other devices of this type have been disclosed in which the center of rotation of the connecting link driven by the cam is supposed to be adjusted on a circular path (OS 195 32 334 A1; EP 0 717 174 A1; DE 101 64 493). However, the previous publications do not contain any teaching about how to construct the devices to realize such adjustment.

However, the prior art device has some disadvantages. All known devices have the common disadvantage that due to manufacturing tolerances the more the valve strokes of the individual cylinders are reduced for the purpose of controlling the load, the greater their differences relative to one another. Moreover, the valve strokes of the gas exchange valves of the same cylinder cannot be changed independently. Completely shutting off the gas exchange valves, that is keeping them closed constantly, and the possibility of turning off a cylinder by completely turning off all intake and/or exhaust valves of individual cylinders, has also not previously been known. Another disadvantage results from the fact that the adjustment of the valve lifting curve occurs during the valve stroke of at least individual gas exchange valves. This requires a high adjusting force, that is, a high adjustment torque with high adjusting power.

SUMMARY OF THE INVENTION

It is an object of the invention to create a device which avoids the disadvantages of the prior art and allows additional variability for valve actuation that is entirely mechanical.

The displacement of the transmission elements, which causes the change in the valve lifting curve, is performed in separate units for each gas exchange valve or in separate units for several gas exchange valves, each of which is adjacent, and this is done in such a way that these units are adjusted independently of one another, at least some of the time.

In one embodiment of the invention, the position of the changeable transmission element on the respective adjustment curve preferably is determined by direct or indirect contact with one or more cam disks, which are put on one or more adjusting shafts that are connected in a torsionally rigid manner. In another embodiment, the cam disks are put on an axially displaceable adjusting axle. The adjusting shaft or the adjusting axle can in turn be rotated or displaced through a suitable transmission or a connecting element by an adjusting motor. Of course the adjustment can also be accomplished by hydraulic elements. If the units are guided by a linearly adjustable slide, the adjustment can also be accomplished directly from the adjusting motor through a spindle which has a movement thread.

All embodiments also share the fact that the connecting links or their cam rollers have to be held in contact with the cams by special springs. This is immediately seen from the situation at zero lift, when there is cylinder cutout.

The inventive device, including an adjusting motor or an adjusting device, can be separately provided for every valve of an engine, so that any combination of valve strokes or opening angles of the individual valves of an engine is possible, including the turning off of individual cylinders. However, as a rule common adjustment of several valves is provided. This applies especially for intake and exhaust valves of a cylinder in multiple-valve engines. For example, two intake valves can be actuated by a cam through a connecting link which has a radial cam for each valve. Since only one connecting link and only one guide of the units are present, both valves are adjusted together and in the same way. However, the inventive device also allows the common connecting link to have two different radial cams on it with the result of two different lifting curves on the two valves, despite the fact that they are adjusted together. This variant makes it possible, especially in the lowest load range, to open only one of the two valves. The special advantage of this possibility is that in the lowest load range it is only necessary to expose very small cross sections which can be more precisely observed, if they are only exposed by one valve. In addition, opening only one of the intake valves makes it possible to produce swirl in the cylinder charge. The inventive device further expands the possibilities for producing different valve lifting curves for two intake or exhaust valves of a cylinder by the fact that two different cams and two connecting links are used with different radial cams. Nevertheless, the two valves can be adjusted together, since the two connecting links can be mounted on a common unit.

It is also possible to adjust the displacement of transmission elements which cause a change in the valve lifting curve of a larger number of parallel valves together by an adjusting motor or mechanism, especially when it is mounted on a common unit.

Since it is of great significance for the acceptance of variable valve actuation, that is also the inventive device, to keep the adjusting power small, and since it is higher when the device or its slip joints and links are in loaded condition than when they are in the load-free state that is present to a great extent when the valve is closed, the inventive device provides adjustment essentially during the common rest phases of all valves to be adjusted in common. These rest phases are derived from the signals of [sensors on] the crankshaft and the camshaft, and become shorter and shorter the more valves are adjusted together. Thus, the number of valves adjusted together is limited.

The common adjustment of the intake and exhaust valves only of one cylinder in every case produces long rest phases that are "friendly" to adjustment. However, it also makes possible individual load control of the individual cylinders with an inventive adjustment strategy that involves controlling the torques of the individual cylinders for each load state of the entire engine. This is essential for engine smoothness, especially in the lower load range, since manufacturing tolerances mean that the valve strokes do not sufficiently coincide. The signals necessary for this adjustment strategy are also supplied by the rotational angle sensor of the crankshaft and assigned to the individual cylinders by the rotational angle sensor of the camshaft.

In a variant of the inventive design, the displacement of transmission elements, which causes the change in the valve lifting curve, is implemented by means of a common, rotatable adjusting shaft with cam disks. If the adjustment of all or at lease some of the intake and exhaust valves is largely independent, this offers the possibility of turning off selected valves by means of the continuous adjusting shaft, that is no longer opening them or at least adjusting a smaller valve stroke. To accomplish this, sections of the described cam disks of the adjusting shaft are formed as a rest for the valves that are not turned off. The rest area is a contour which is formed from an arc that is concentric to the center of rotation of the adjusting shaft. Rotation of the adjusting shaft does not change the valve stroke of the displacement units controlled by the cam disks with rest within the active area of the rest, while the valve stroke of the displacement units controlled by the cam disks without rest is changed. This change can be carried out until the valve(s) is/are held completely closed. If all intake valves or/and the exhaust valves of the same cylinder are triggered in this way, the change in load is turned off for selected cylinders. Of course the same function is achieved by using a straight guided draw key with a corresponding cam contour. The rest area is then a contour which is formed from a line parallel to the sliding direction of the draw key.

BRIEF DESCRIPTION OF THE DRAWINGS

The invention is explained in greater detail below by means of drawings of a few sample embodiments. In the associated drawings.

DETAILED DESCRIPTION OF THE INVENTION

Figure 1:
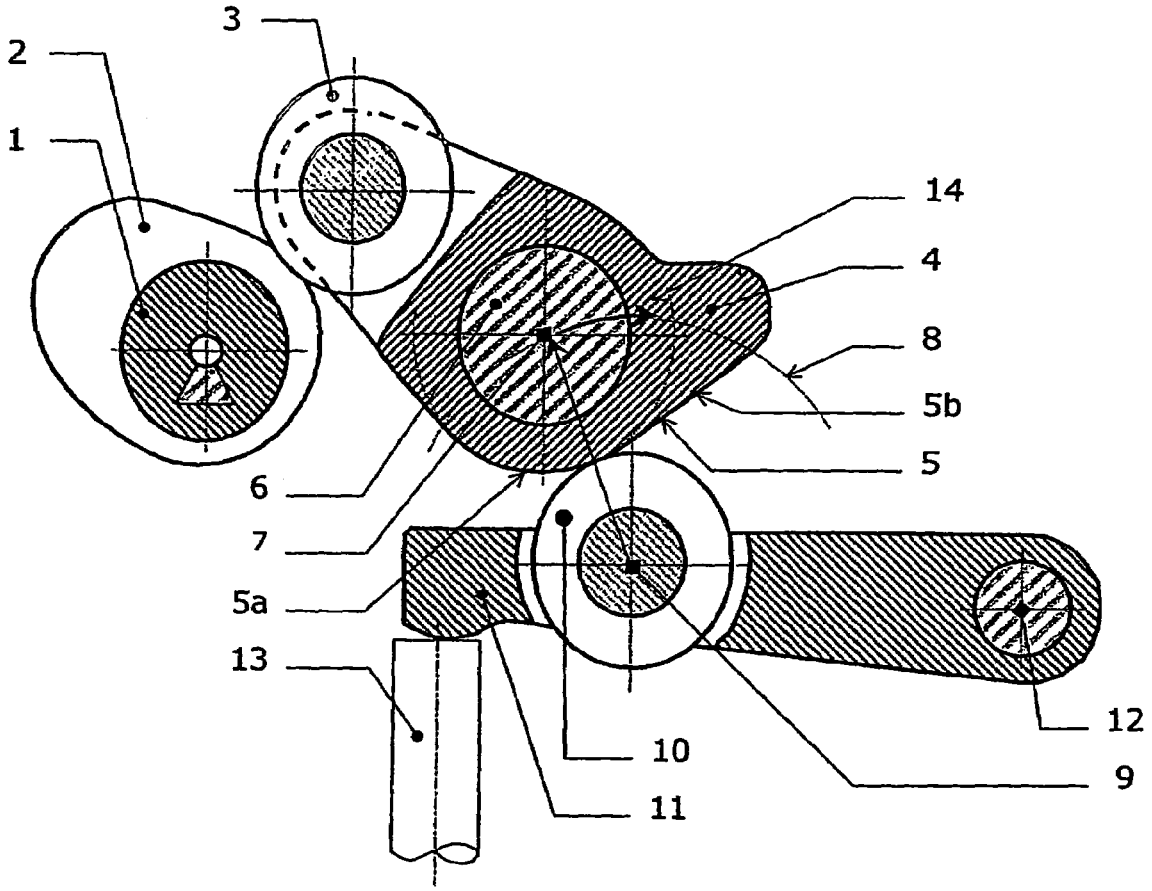
FIG. 1 shows the moving parts of the generic device, which are involved in the flow of force from the camshaft to the valve.

FIG. 1 shows a camshaft 1, which has a cam 2. The cam moves roller 3 at the end of connecting link 4. Connecting link 4 has a radial cam 5 which is composed of a rest area 5*a* and a lift area 5*b*. Connecting link 4 is mounted on a bolt 6 whose axis 7 is guided on an arc-shaped adjustment curve 8. The center of the arc-shaped adjustment curve 8 is on the axis 9 of the roller 10 of the driven element 11 which is supported through a link 12 in a housing (not shown) and actuates valve 13. It can clearly be seen that adjustment of axis 7 on the adjustment curve 8 in the direction of arrow 14 has the consequence of reducing the opening angle and stroke of valve 13.

Figure 2:
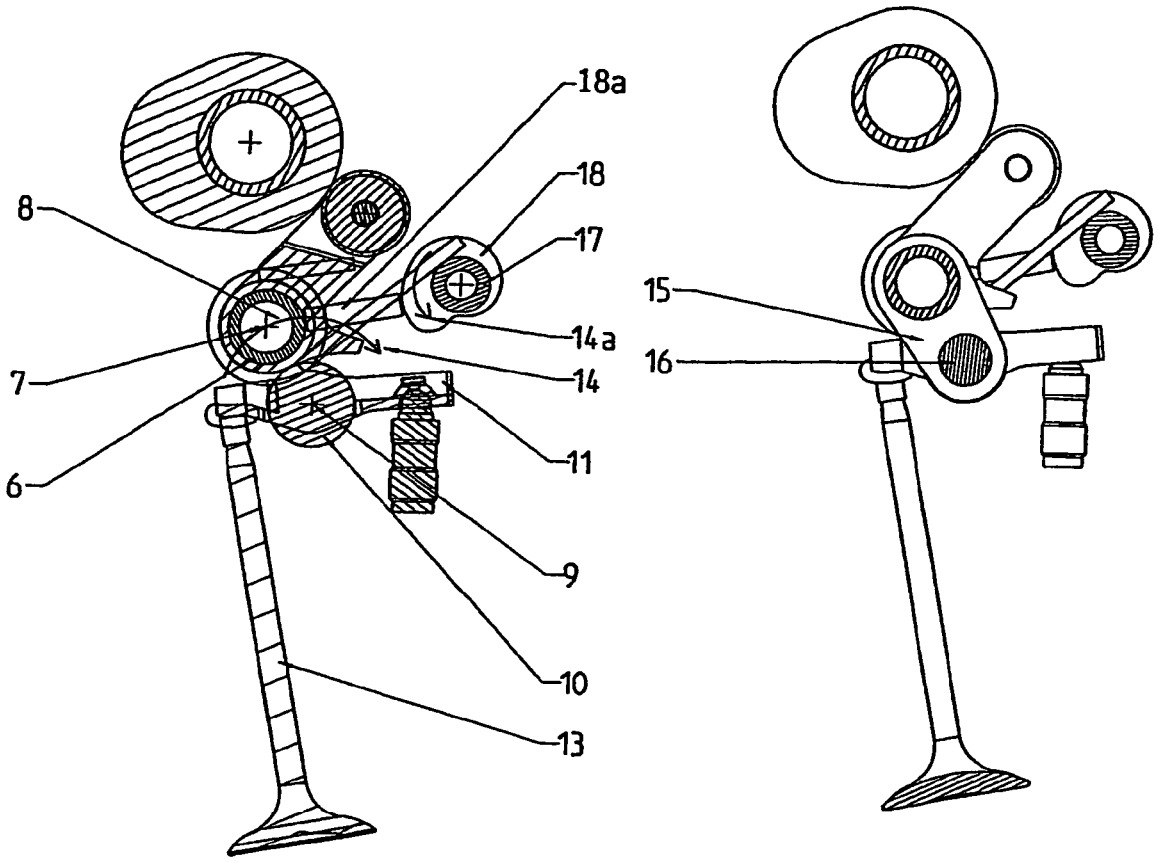
FIG. 2 shows a cross-section using the parts shown in FIG. 1 with a pendulum support and adjusting shaft.

FIG. 2 shows an embodiment in which the bolt 6 or its axis 7 is guided on the arc-shaped adjustment curve 8 by form-fit connection to a pendulum support 15. Cylinder head-side link 16 of pendulum support 15 or its axis coincides with the axis 9 of roller 10 of driven element 11. Adjusting shaft 17 holds cam disks 18, which determine, through tappet 18*a*, the position of bolt 6 or its axis 7 on the adjustment curve 8. Axis 7 is adjusted on adjustment curve 8, as shown by arrow 14, by rotation of cam disk 18 or adjusting shaft 17 in the direction arrow 14*a*. The described adjustment movement has the consequence of reducing the stroke and opening angle of valve 13.

Figure 3:
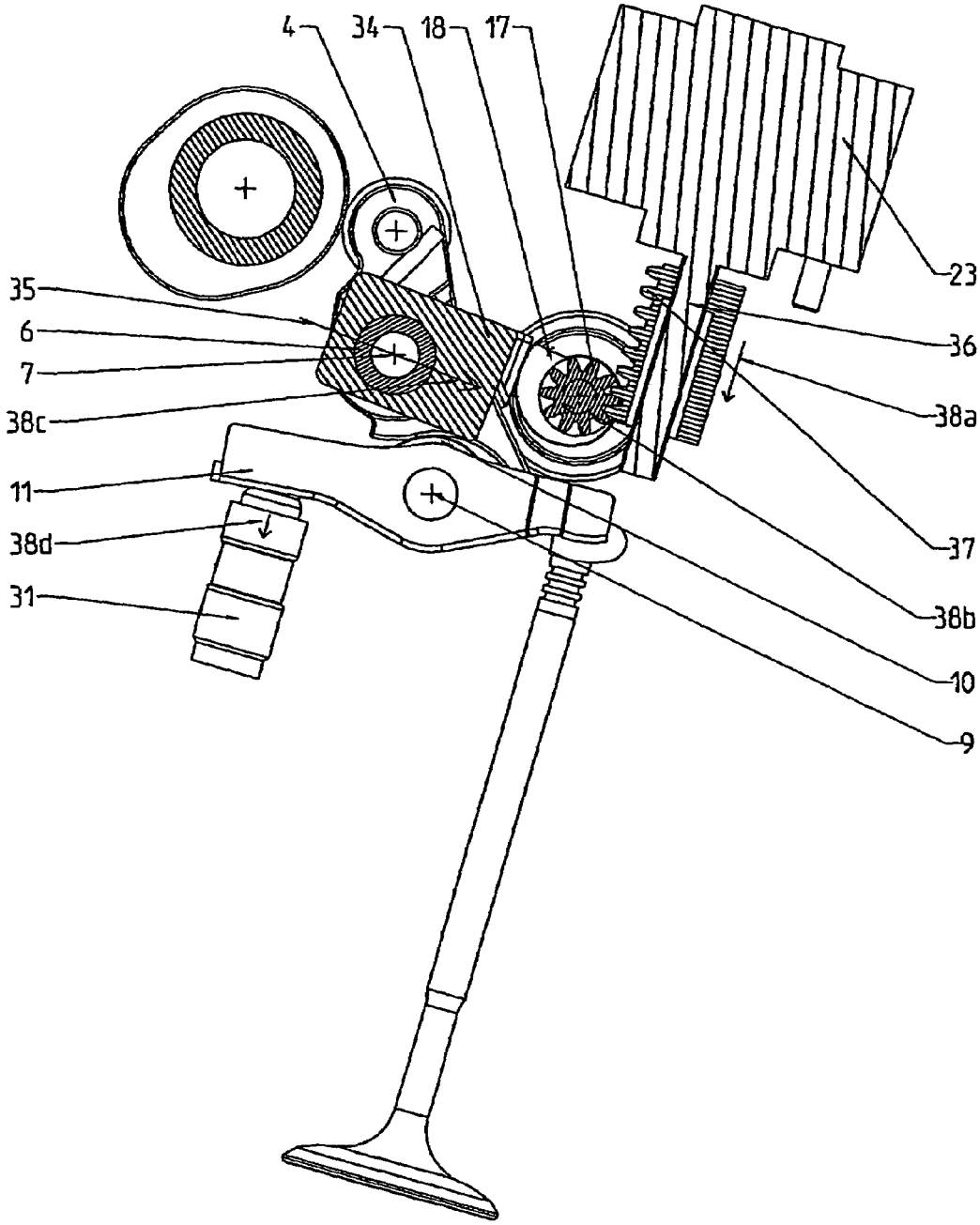
FIG. 3 is a cross-section through the device with a slide, adjusting shaft, and adjusting motor.

FIG. 3 shows a cross-section through an embodiment of the invention using a slide 34, which can be used separately for each valve or each pair of valves. The separate use for individual valves results in the longest possible rest phases or common rest phases, so that it is easy for the adjustment to be done only during the rest phases. Controlling the individual cylinders using the inventive device even requires the separate arrangement. In this embodiment, bolt 6 is guided in a form-fit manner in the housing by slide 34, so that its axis 7 is guided along adjustment curve 35, a line. This line is a tangent and only more or less approximates an arc about the axis 9 of roller 10 of the resting driven element 11. The deviation is exaggerated in FIG. 3. Now if the threaded spindle 36 driven by adjusting motor 23 rotates and displaces toothed rack 37 by the amount shown by arrow 38*a*, then adjusting shaft 17 and cam disk 18 rotate according to arrow 38*b* and slide 34 along with bolt 6 are displaced by amount 38*c*. Because of the deviation of straight adjustment curve 35 from the shape of an arc, play compensation element 31 must be lowered by a certain amount, which is shown by arrow 38*d*.

Figure 4:
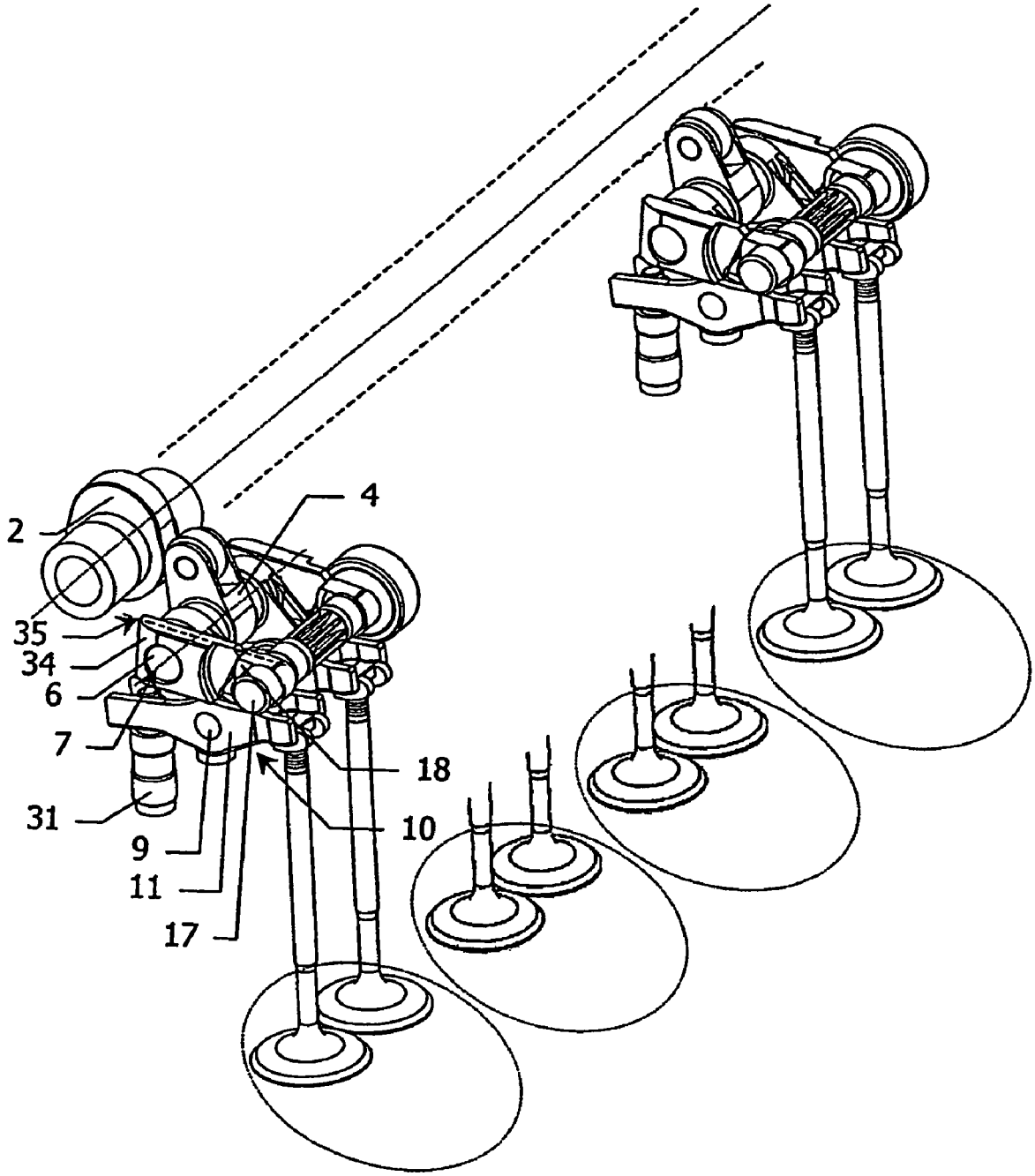
FIG. 4 is a perspective view of the inventive device with a slide and adjusting shafts in an inline 4 cylinder engine.

FIG. 4 is a perspective view of the inventive device with a slide 34 which is separate for each pair of valves of a cylinder. In this embodiment, slide 34 guides bolt 6 in a form-fit manner in the valve train housing (not shown), so that its axis 7 is guided along the adjustment curve 35, a straight line. This line is only more or less approximately an arc about the axis 9 of roller 10 of the resting driven element 11. Because of the deviation of the straight adjustment curve 35 from the shape of an arc, play compensation element 31 must take up a certain amount. Axis 7 is adjusted on adjustment curve 35 by rotation of cam disk 18 or adjusting shaft 17. The figure shows that in each cylinder a pair of valves is actuated by means of a cam 2 and a connecting link 4, which is mounted in a slide 34 on a bolt 6, whose position in the valve train housing is guided along an adjustment curve 35 in a form-fit manner, and is positioned by means of an adjusting shaft 17 through cam disks 18. If the adjusting shaft 17 of a cylinder should now rotate, then the position of this cylinder's slide 34, and thus the valve lifting curve of both of this cylinder's valves, is changed. The relationships for the other cylinders do not change. Here it would also be possible, as is shown later in FIG. 6, for a common adjusting shaft to position the displacement units of a cylinder group or a cylinder head.

Figure 5:
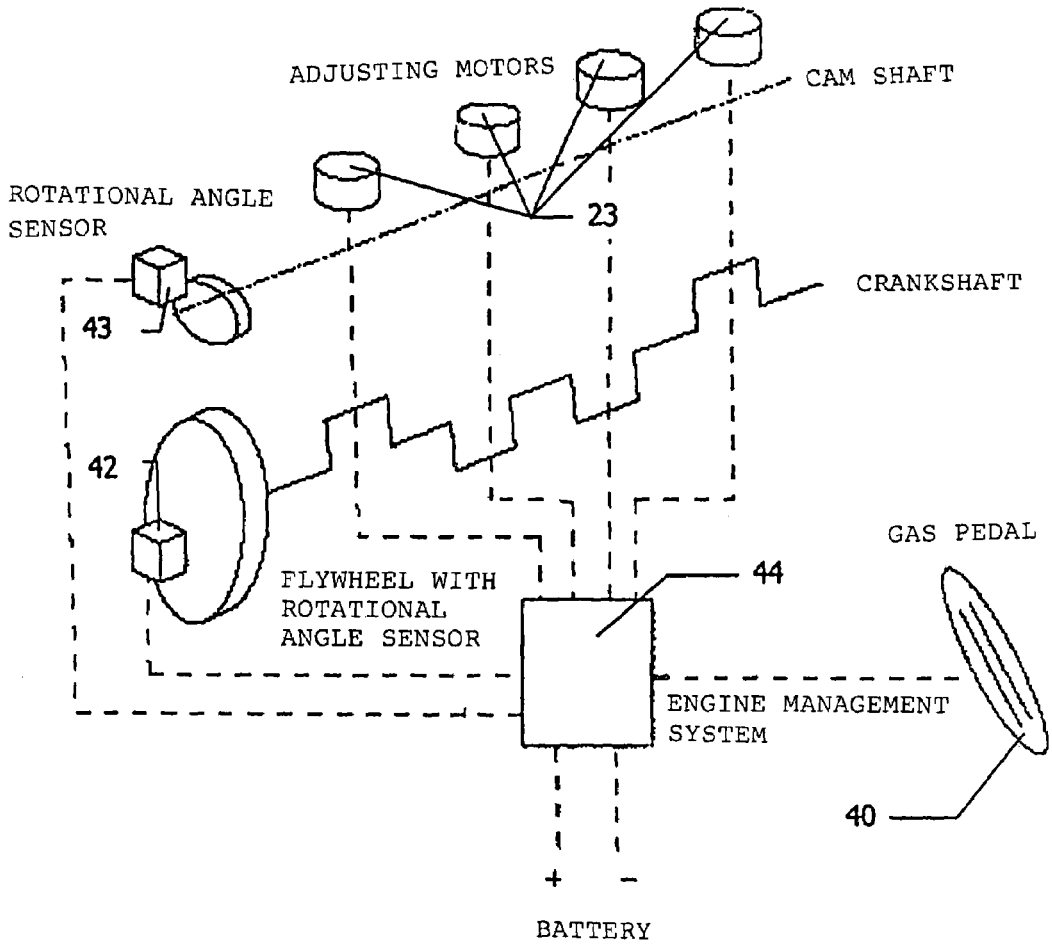
FIG. 5 is a diagrammatic representation of the interaction of the engine management system, the gas pedal, the rotational angle sensor, adjusting motors, and battery

FIG. 5 is a diagrammatic representation of the interaction of gas pedal 40, adjusting motors 23, rotational angle sensor 42 on the flywheel, and rotational angle sensor 43 on the camshaft with the engine management system 44. A signal coming from gas pedal 40, that is from a sensor for its position, is converted by engine management system 44 into a signal to adjusting motors 23 to increase or reduce the valve strokes. After the desired load state is achieved for the entire engine, the engine management system 44 evaluates the signals from the high-resolution rotational angle sensor 42 on the flywheel. They are assigned to the individual cylinders with the help of the low-resolution rotational angle sensors 43 on the camshaft or on another shaft running at half the crankshaft speed. This information is used to send signals to the individual adjusting motors 23 to even out the torque peaks or the crankshaft speed, by correcting the valve strokes of the cylinders with smaller torques upward and correcting those of the cylinders with larger torques downward. In the inventive process an adjustment takes place, with or without compensation, during the common rest phases of the valves operated by an adjusting motor. The engine management system 44 takes their phase positions from sensor 43 of the camshaft.

Figure 6:
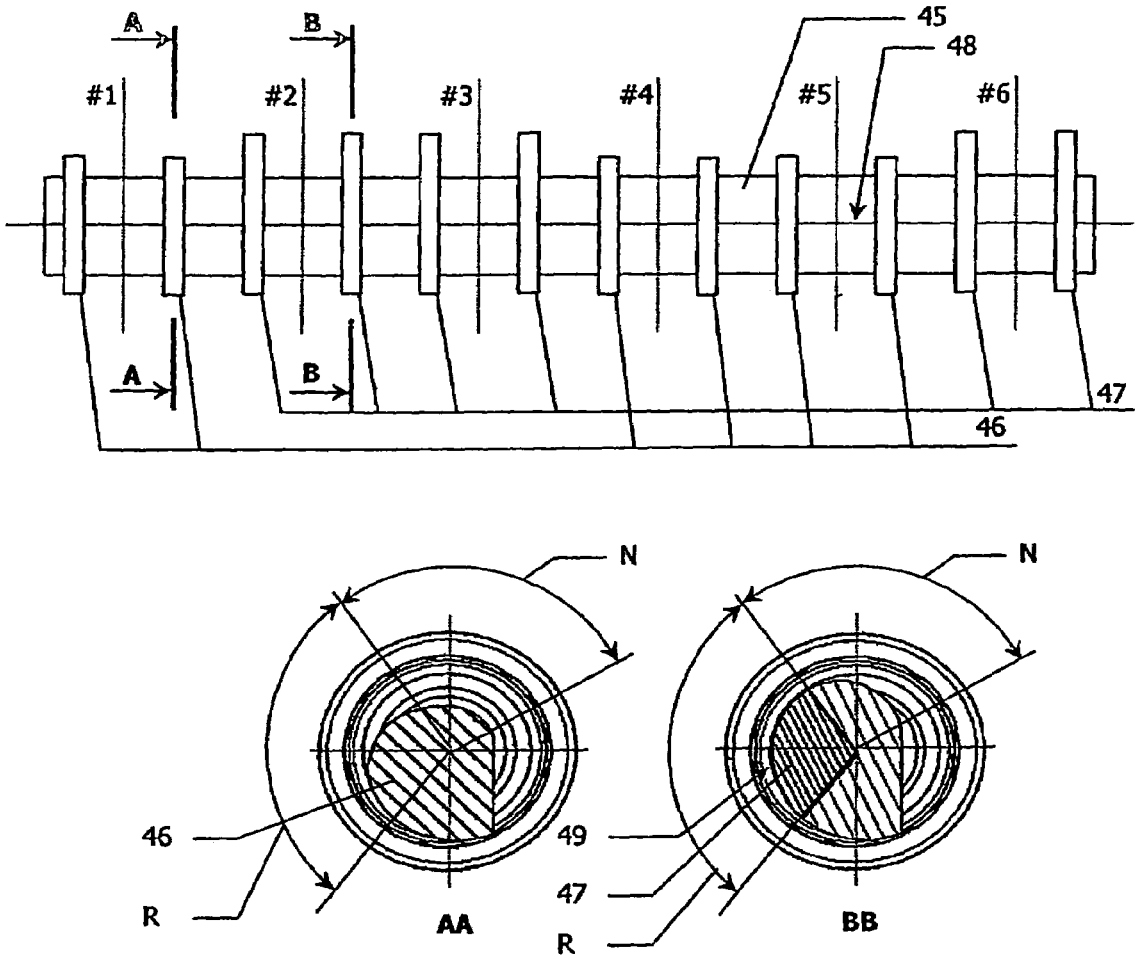
FIG. 6 is a diagrammatic representation of a continuous adjusting shaft and a section through each of two cam disks for positioning a cylinder's displacement unit.

FIG. 6 is a diagrammatic representation of a continuous adjusting shaft 45 of an inline 6-cylinder engine, as well as a section through one of two cam disks for positioning a cylinder's displacement unit. The adjusting shaft carries cam disks 46, 47 for positioning the displacement units for the six cylinders. Each of the cam disks 46 for cylinders #1, #4, and #5, as well as cam disks 47 for cylinders #2, #3, and #6 are the same. AA shows a cross section through the cam disks 46, and BB shows a cross section through cam disks 47. Sector R of cam disk 47 is formed by an arc 49 that is concentric to the center of rotation 48 of adjusting shaft 45, while in the corresponding sector of cam disk 46 the adjusting cam curve continuously leads to a smaller distance to the center of rotation 48. Such a design of cam disks 46 and 47 has the result that when adjusting shaft 45 is rotated about its center of rotation 48, the displacement units for the valves of cylinders #1, #4, and #5 are further displaced in the active area of sector R, while the displacement units for the valves of cylinders #2, #3, and #6 remain at rest. In this way, a corresponding design of the valve train can, for example, keep the valves of cylinders #1, #4, and #5 constantly closed in the adjacent active area of sector N, while the valves of cylinders #2, #3, and #6 still execute a stroke.

LIST OF REFERENCE NUMBERS

1 Camshaft
2 Cam
3 Roller
4 Connecting link
5 Radial cam
5*a* Rest area
5*b* Lift area
6 Bolt
7 Axis
8 Adjustment curve
9 Axis
10 Roller
11 Driven element
12 Link
13 Valve
14 Arrow
14*a* Direction arrow
15 Displacement unit
16 Link
17 Adjusting shaft
18 Cam disk
18*a* Tappet
19 Intake valve
20 Exhaust valve
21 Sliding block
22 Articulated shaft
23 Adjusting motor
31 Play compensation element
34 Slide, displacement unit
35 Adjustment curve
36 Threaded spindle
37 Toothed rack
38*a* Arrow
38*b* Arrow
38*c* Amount
38*d* Arrow
40 Gas pedal
42 Rotational angle sensor
43 Rotational angle sensor
44 Engine management system, control unit
45 Adjusting shaft
46 Cam disk
47 Cam disk
48 Center of rotation
#1 Cylinder
#2 Cylinder
#3 Cylinder
#4 Cylinder
#5 Cylinder
#6 Cylinder
R Sector
N Sector Key for Figures

| | |
|---|---|
| Batterie | Battery |
| Drehwinkelsensor | Rotational angle sensor |
| Fahrpedal | Gas pedal |
| Figur | Figure |
| Kurbelwelle | Crankshaft |
| Motormanagement | Engine management system |
| Nockenwelle | Camshaft |
| Schwungrad mit Drehwinkelsensor | Flywheel with rotational angle sensor |
| Verstellmotoren | Adjusting motors |

The invention claimed is:

1. A device for variable actuation of gas exchange valves of internal combustion engines with a plurality of cylinders, comprising: a camshaft with at least one cam; a housing, said camshaft being mounted in said housing and rotating as a function of engine speed; a connecting link and a first curved link, said connecting link being actuatable by said cam through said first curved link; a driven element for transferring motion to said gas exchange valves and connected to said connecting link; at least one other curved link between said connecting link and said driven element, said other curved link having a first section in which no lifting motion for said gas exchange valves is transferred through said driven element, said curved link having a second section in which lifting motion for said gas exchange valves is transferred through said driven element with the capability of displacing at least one transmission element along a displacement path and modifying thereby the course of a lifting curve of said gas exchange valves; a plurality of displacement units, gas exchange valves of one cylinder in one of said displacement units being displaced together and independently of displacement units of other cylinders; separate actuators for each displacement unit for operating said displacement unit; rotational angle sensors for capturing rotational angle signals of a crankshaft and camshaft or another shaft running at half the crankshaft speed for deriving a common resting phase of all valves of a cylinder to be adjusted in common; and a control unit for displacing each displacement unit during said common resting phase.

2. A device as defined in claim 1, wherein two identical cams and two connecting links with identical cams comprise two valves of a cylinder.

3. A device as defined in claim 1, wherein two different cams and two connecting links with different radial cams comprise two valves of a cylinder.

4. A device as defined in claim 1, wherein two identical cams and two connecting links with different radial cams comprise two valves of a cylinder.

5. A device as defined in claim 1, wherein two different cams and two connecting links with identical radial cams comprise two valves of a cylinder.

6. A device as defined in claim 1, wherein a common connecting link together with two identical radial cams comprise intake or exhaust valves of a cylinder.

7. A device as defined in claim 1, wherein a common connecting link together with two different radial cams comprise said valves.

8. A device as defined in claim 1, wherein at least one valve is adjusted to be closed constantly.

9. A device as defined in claim 1, wherein all intake or exhaust valves of a cylinder are combined in a displacement unit.

10. A process for operating an internal combustion engine with a plurality of cylinders with the device of claim 1, and after a desired load state for the engine is reached, comprising the steps of:

(a) picking up angular position signals of the crankshaft with a first rotational angle sensor on a flywheel and evaluating said signals by an engine management system for detecting rotational irregularities of the crankshaft and torque peaks;

(b) assigning said angular position signals to individual cylinders by a second rotational angle sensor arranged on the camshaft rotating at half the crankshaft speed; and (c) producing signals going to drives for individual displacement units to smooth out torque peaks and crankshaft speed by correcting valves strokes of cylinders with smaller torques upward and correcting cylinders with larger torques downward.

11. A process for operating an internal combustion engine with a plurality of cylinders with the device of claim 1, comprising steps of:

(a) assigning each cylinder to a separate one of said device and an actuator to operate the device;

(b) determining phase position of rest phases of individual valves operated by an actuator; and (c) applying adjustment movement of respective devices during common rest phases of valves operated by a respective displacement unit.

12. The process as defined in claim 11, wherein phase position of rest phases of individual valves is determined by an engine management system from a signal of a rotational angle sensor arranged on the camshaft.

13. A device for variable actuation of gas exchange valves of internal combustion engines with a plurality of cylinders, comprising: a housing; a camshaft with at least one cam mounted in said housing and rotating as a function of engine speed; a connecting link and a first curved link, said connecting link being actuatable by said cam through said first curved link;, a driven element for transferring motion to said gas exchange valves and connected to said connecting link; at least one other curved link between said connecting link and paid driven element, said other curved link having a first section in which no lifting motion for said gas exchange valves is transferred through said driven element, said curved link having a second section in which lifting for said gas exchange valves is transferred through said driven element with the capability of displacing at least one transmission element along a displacement path and modifying thereby the course of a lifting curve of said gas exchange valves;

a plurality of displacement units to affect lifting motion of said gas exchange valves, at least one of said displacement units carrying out displacement to affect lifting motion of at least one gas exchange valve independently of displacement of other displacement units;

a common adjusting shaft and at least one cam disk per displacement unit for adjusting on said displacement path respective required positions of transmission elements by said cam disk for a number of gas exchange valves, said transmission elements being supportable in direction of displacement;

said cam disk causing no change in position of said transmission elements guided on said displacement path when said adjusting shaft is rotated;

and a cam disk on at least one other displacement unit causing a change in position of said transmission elements guided on said displacement path when said adjusting shaft is rotated.

14. A device as defined in claim 13, wherein said cam disk has as sector having an adjusting cam curve leading continuously to a smaller distance to a center of rotation of said adjusting shaft.

15. A device as defined in claim 14, wherein said cam disk has a contour with a second sector arranged adjacent to said first-mentioned sector and having an adjusting cam curve such that valves of a cylinder actuated when said second sector becomes active remain constantly closed, said cam disk having a contour with a corresponding second sector with a contour curve such that valves of a cylinder actuated when said corresponding second sector becomes active still execute a lift.

16. A device as defined in claim 13, wherein said adjusting shaft has a plurality of first identical cam disks and a plurality of second identical cam disks arranged thereon, each of said first identical cam disks and of said second identical cam disks being oriented so that they have the same angular position to one another and are thereby not rotated with respect to one another.

* * * * *